US008714684B2

(12) United States Patent
Yamada

(10) Patent No.: US 8,714,684 B2
(45) Date of Patent: May 6, 2014

(54) PRINTING APPARATUS AND DOUBLE-SIDED PRINTING CONTROL PROGRAM

(75) Inventor: Akihiro Yamada, Nagoya (JP)

(73) Assignee: Brother Kogyo Kabushiki Kaisha, Nagoya-shi (JP)

( * ) Notice: Subject to any disclaimer, the term of this patent is extended or adjusted under 35 U.S.C. 154(b) by 0 days.

(21) Appl. No.: 13/326,371

(22) Filed: Dec. 15, 2011

(65) Prior Publication Data

US 2012/0194596 A1 Aug. 2, 2012

(30) Foreign Application Priority Data

Jan. 31, 2011 (JP) ..... 2011-018146

(51) Int. Cl.
*B41J 29/38* (2006.01)

(52) U.S. Cl.
USPC ..... 347/16; 347/104; 347/5; 347/101

(58) Field of Classification Search
CPC ..... B41J 29/38
See application file for complete search history.

(56) References Cited

U.S. PATENT DOCUMENTS

| | | | | |
|---|---|---|---|---|
| 6,736,390 | B2 | 5/2004 | Chihara et al. | |
| 7,651,092 | B2 | 1/2010 | Hirao et al. | |
| 2001/0011794 | A1 | 8/2001 | Chihara | |
| 2005/0253886 | A1 * | 11/2005 | Nakajima et al. | 347/16 |
| 2008/0003032 | A1 | 1/2008 | Nonaka et al. | |
| 2008/0174626 | A1 * | 7/2008 | Hirao et al. | 347/16 |
| 2009/0102908 | A1 | 4/2009 | Imoto | |
| 2010/0141700 | A1 * | 6/2010 | Mizutani | 347/16 |
| 2010/0276870 | A1 | 11/2010 | Yamada | |

FOREIGN PATENT DOCUMENTS

| | | | | |
|---|---|---|---|---|
| CN | 101231489 A | | 7/2008 | |
| CN | 101541657 A | | 9/2009 | |
| CN | 101875265 A | | 11/2010 | |
| JP | 06-035265 | * | 2/1994 | G03G 15/00 |
| JP | 6-35265 A | | 2/1994 | |
| JP | 2001-206644 | | 7/2001 | |
| JP | 2004-347927 | * | 12/2004 | B41J 29/38 |
| JP | 2004-347927 A | | 12/2004 | |
| JP | 2006-330250 | | 12/2006 | |

(Continued)

OTHER PUBLICATIONS

JP Office Action mailed Jan. 17, 2013, JP Appln. 2011-018146, English translation.

(Continued)

*Primary Examiner* — Mannish S Shah
*Assistant Examiner* — Jeremy Delozier
(74) *Attorney, Agent, or Firm* — Banner & Witcoff, Ltd.

(57) ABSTRACT

There is provided a printing apparatus including: a printing section; a transport mechanism in which a transport route and a re-transport route are formed, the transport mechanism including an install section to which a transport unit is to be installed; and a print control section which controls the printing section and the transport mechanism to execute a plurality of kinds of double-sided printing processes having different maximum numbers of sheets present at the same time in the transport mechanism from each other so that in a case that the transport unit is installed to the install section, a double-sided printing process in which a maximum number of sheets is large as compared with a case in which the transport unit is not installed to the install section is executed.

14 Claims, 9 Drawing Sheets

(56) References Cited

FOREIGN PATENT DOCUMENTS

| | | | |
|---|---|---|---|
| JP | 2007-030476 | | 2/2007 |
| JP | 2008-033236 | | 2/2008 |
| JP | 4189465 | B2 | 12/2008 |

OTHER PUBLICATIONS

Office Action recieved in corresponding Chinese Patent Application No. 201210017260.0, dated Jan. 13, 2014.

* cited by examiner

PRINTING APPARATUS AND DOUBLE-SIDED PRINTING CONTROL PROGRAM

CROSS REFERENCE TO RELATED APPLICATION

The present application claims priority from Japanese Patent Application No. 2011-018146, filed on Jan. 31, 2011, the disclosure of which is incorporated herein by reference in its entirety.

BACKGROUND OF THE INVENTION

1. Field of the Invention

The present invention relates to a technique of a double-sided printing in which a sheet that has been printed on one surface is reversed and the printing on the other surface thereof is performed.

2. Description of the Related Art

As double-sided printing systems of printing apparatuses, there is well known a system in which printing on one surface of one paper sheet and the printing on the other surface of the one paper sheet are continuously performed and then the printing on one surface of a paper sheet which follows the one paper sheet and the printing on the other surface of the paper sheet which follows the one paper sheet are continuously performed (hereinafter referred to as a double-sided continuous system). On the other hand, there is a printing apparatus which adopts the following system. That is, the printing on one surface of another paper sheet is performed during a time after the printing on one surface of one paper sheet is performed and before the printing on the other surface of the one paper sheet is performed, that is, the printing on one surface of one paper sheet and the printing on one surface of another paper sheet are continuously performed (hereinafter referred to as a single-sided continuous system). According to the single-sided continuous system, a length of time after the printing on one surface of one paper sheet is performed and before the printing on the other surface of the one paper sheet is performed (i.e. a time for reversing the paper sheet) can be allocated to the printing on another paper sheet. Therefore, in a case that the single-sided continuous system is adopted, it is possible to perform a printing process faster than a case in which the double-sided continuous printing system is adopted, in an amount of time corresponding to the time for reversing the paper sheet.

Here, conventionally, there is a printing apparatus which is aimed at improving the number of sheets to be subjected to the printing process (a throughput) per unit time with respect to a sheet having a short sheet-length unless a transport speed of the sheet is increased. It is noted that the sheet-length refers to a length of the sheet in the transport direction. The above printing apparatus is configured as follows. That is, in a case that the sheet to be used has the short sheet-length, a larger number of sheets are made to wait in a re-reversing route as compared with a case in which the sheet to be used has a long sheet-length.

SUMMARY OF THE INVENTION

In the printing apparatus described above, improvement of the throughput when the printing is performed on the sheet having the short sheet-length is merely considered. However, for example, there is a printing apparatus in which in a case that a transport unit is installed to the printing apparatus, a re-transport route for guiding the sheet having passed through a printing position to the printing position again becomes longer. In such a printing apparatus, when the re-transport route increases in length, the throughput is likely to deteriorate in some cases. Further, in the printing apparatus described above, even when the sheet-length is short, if the re-transport route is long, the throughput deteriorates as well.

In the present description, there is disclosed a technique, in which even when the re-transport route of the sheet becomes longer due to installation of the transport unit, deterioration of the throughput of the double-sided printing can be suppressed.

According to the first aspect of the present teaching, there is provided a printing apparatus which performs printing on a sheet, including:

a printing section which performs the printing on the sheet at a printing position;

a transport mechanism in which a transport route which guides the sheet to the printing position and a re-transport route which guides the sheet having passed through the printing position to the printing position again are formed, the transport mechanism including an install section to which a transport unit, in which an extended route connected to the re-transport route to form a part of the re-transport route thereby lengthening a length of the re-transport route is formed, is to be installed; and a print control section which controls the printing section and the transport mechanism to execute a plurality of kinds of double-sided printing processes having different maximum numbers of sheets present at the same time in the transport mechanism from each other so that in a case that the transport unit is installed to the install section, a double-sided printing process, among the double-sided printing processes, in which a maximum number of sheets is large as compared with a case in which the transport unit is not installed to the install section is executed.

According to the present teaching, even when the re-transport route of the sheet is long due to the installation of the transport unit, it is possible to suppress deterioration of throughput of the double-sided printing.

According to a second aspect of the present teaching, there is provided a non-transitory tangible media storing a double-sided printing control program which makes a computer of an image forming apparatus execute an installation judging and a print controlling, wherein the image forming apparatus includes a printing section which performs printing on a sheet at a printing position; and a transport mechanism in which a transport route that guides the sheet to the printing position and a re-transport route that guides the sheet having passed through the printing position to the printing position again are formed, and the transport mechanism includes a install section to which a transport unit, in which an extended route which is connected to the re-transport route to form a part of the re-transport route thereby lengthening a length of the re-transport route is formed, is installed;

the installation judging is a process in which whether or not the transport unit is installed to the install section is judged; and the print controlling is a process in which under a condition that it is judged the transport unit is installed to the install section in the installation judging, a double-sided printing process, in which a maximum number of sheets present at the same time in the transport mechanism is large as compared with a case in which it is judged the transport unit is not installed to the install section in the installation judging, is executed by the printing section and the transport mechanism.

The present teaching can be realized in various aspects, such as recording media etc., in which a computer program for realizing methods or apparatus functions with respect to a control apparatus, a control method, a printing apparatus, and a printing method is stored.

DESCRIPTION OF THE PREFERRED EMBODIMENTS

First Embodiment

Figure 1:
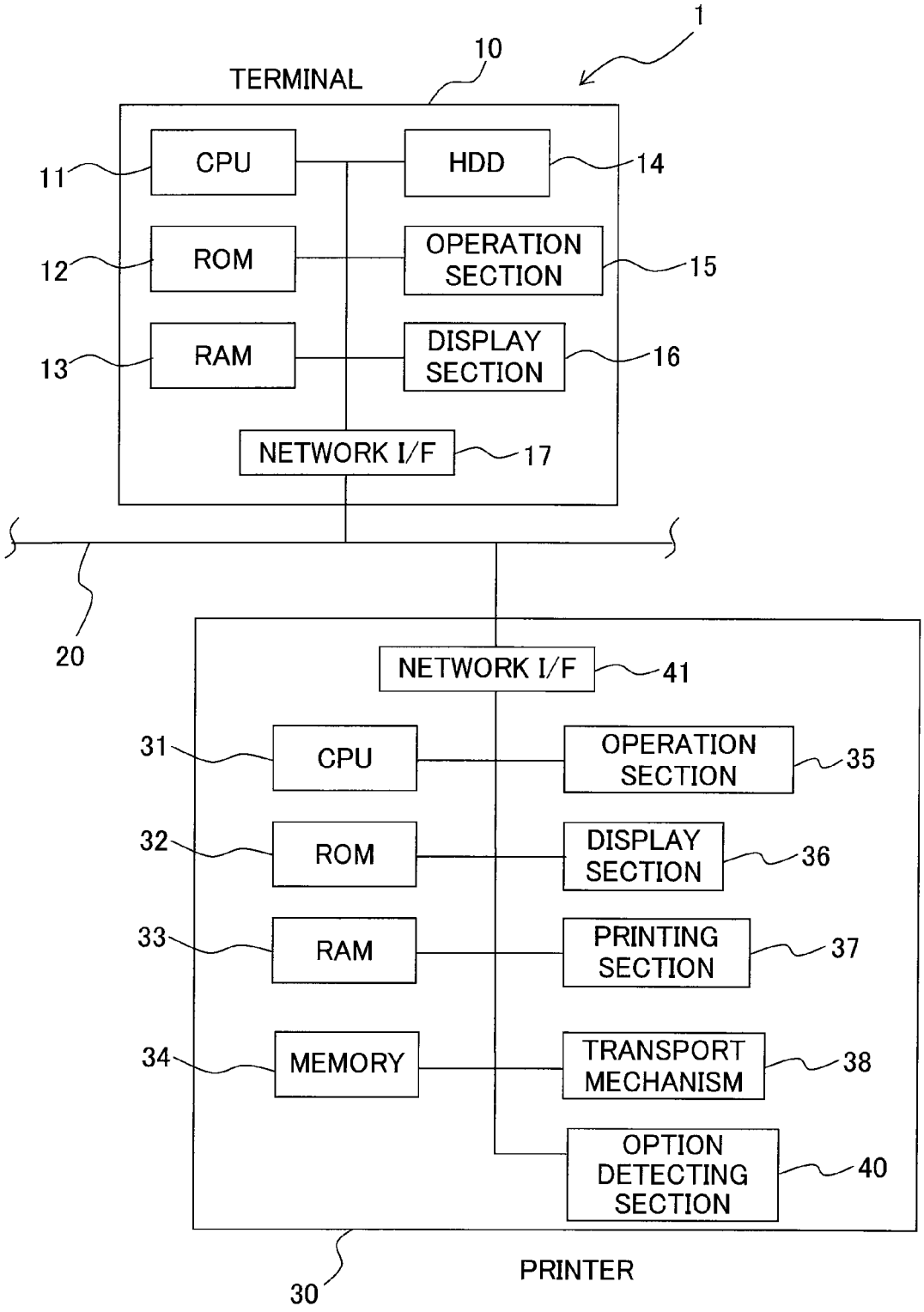
FIG. 1 is a block diagram showing an electrical construction of a printing system according to the first embodiment.

The first embodiment will be explained with reference to FIG. 1 to FIG. 5.

1. Electrical Construction of Printing System

A printing system 1 is provided with a terminal 10 (for example a personal computer) and a printer 30 (an example of a printing apparatus). The terminal 10 is provided with a CPU 11, a ROM 12, a RAM 13, a hard disk drive (HDD) 14, an operation section 15 including a keyboard, a pointing device, etc., a display section 16 including a liquid crystal display etc., a network interface (network I/F) 17 connected to a communication line 20, and the like. Various programs, such as OS (operating system), application software which is capable of creating data for printing, a printer driver for controlling the printer 30, are stored in the hard disk drive 14.

The printer 30 is provided with a main body 30A and an optional unit 60 (shown in FIG. 3 etc., an example of a transport unit) which is installable to the main body 30A. The main body 30A is provided with a CPU 31 (an example of a print control section), a ROM 32, a RAM 33, a memory 34 including a NVRAM, a flash ROM, etc., an operation section 35, a display section 36, a printing section 37, a transport mechanism 38, a network interface (network I/F) 41, sheet detecting sections 40, etc. The ROM 32 stores a program for a printing process as will be described later and various programs for controlling an operation of the printer 30. The CPU 31 controls the operation of the printer 30 while storing, in the RAM 33, a processing result in accordance with the program read from the ROM 32.

The operation section 35 is provided with a plurality of buttons through which a user is capable of performing various input operations, such as the instruction to start the printing. The display section 36 includes the liquid crystal display, a lamp, and the like. Various setting screens, various operation states, etc. can be displayed on the display section 36. The printing section 37 performs the printing onto a sheet W including a paper sheet etc. The network interface 41 is connected to the external terminal 10 etc. via the communication line 20, and thereby making it possible to perform a data communication between the terminal 10 and the printer 30. The transport mechanism 38 and the sheet detecting sections 40 will be described later. The communication line 20 may be either wireless or wired.

2. Internal Structure of Printer

Figure 2:
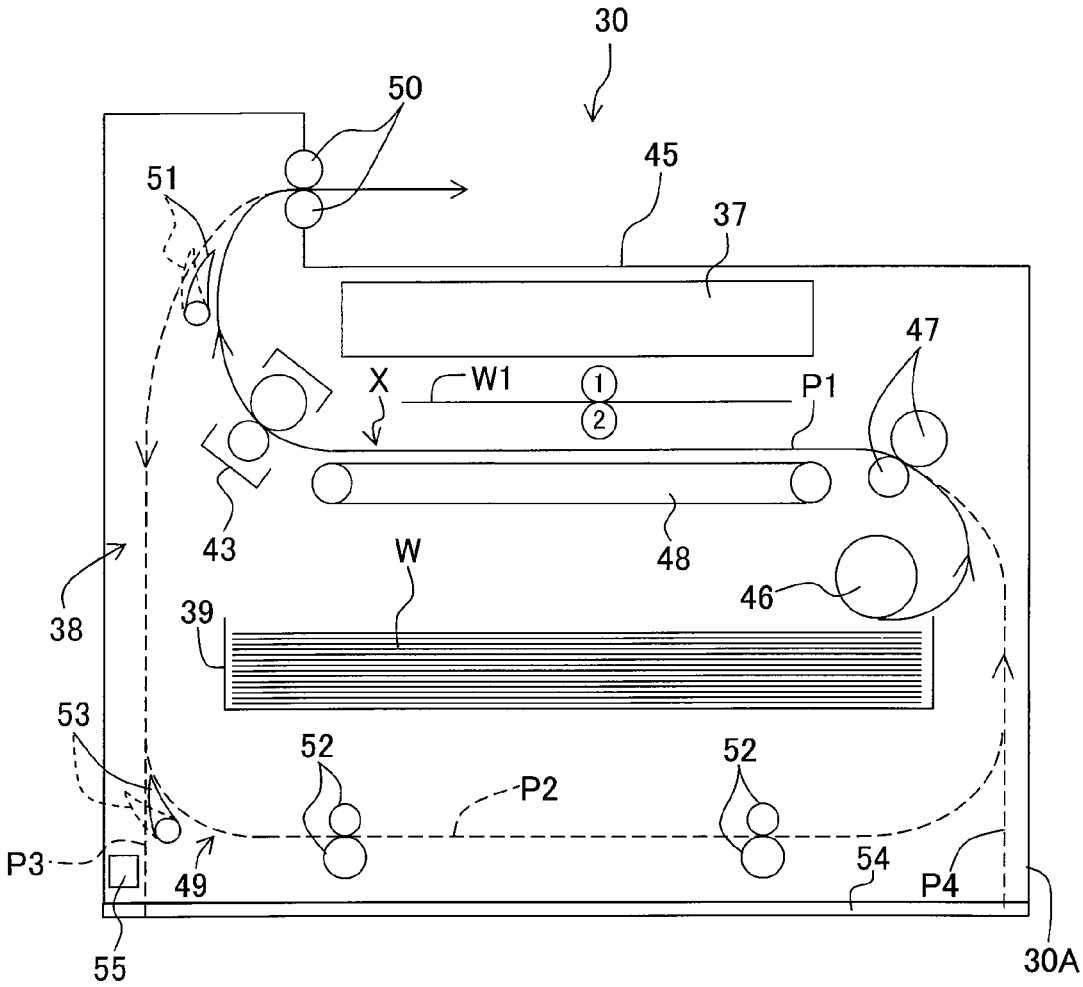
FIG. 2 schematically shows an internal structure of a printer executing a 21 mode.
Figure 3:
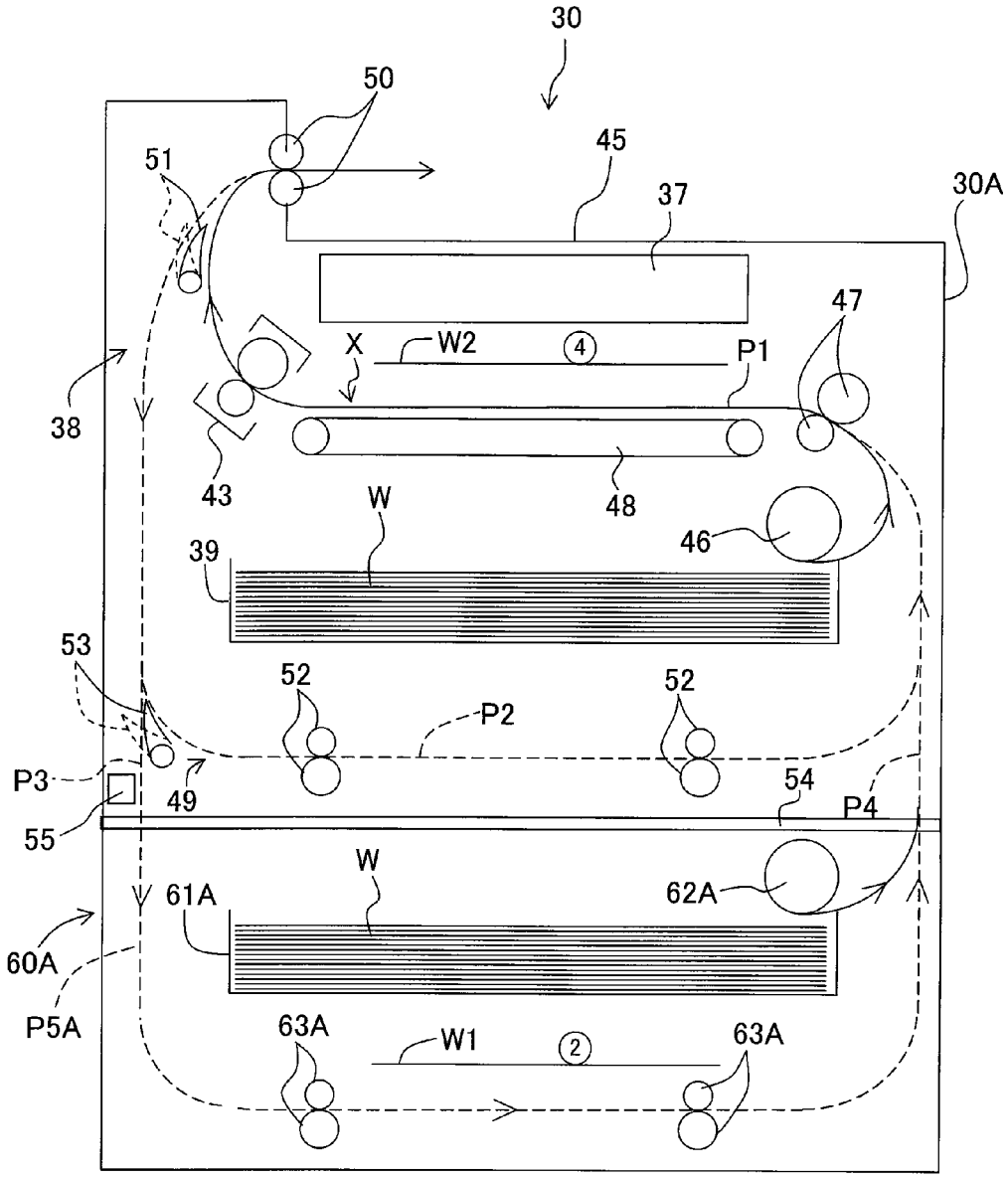
FIG. 3 schematically shows an internal structure of a printer executing a 2413 mode.
Figure 4:
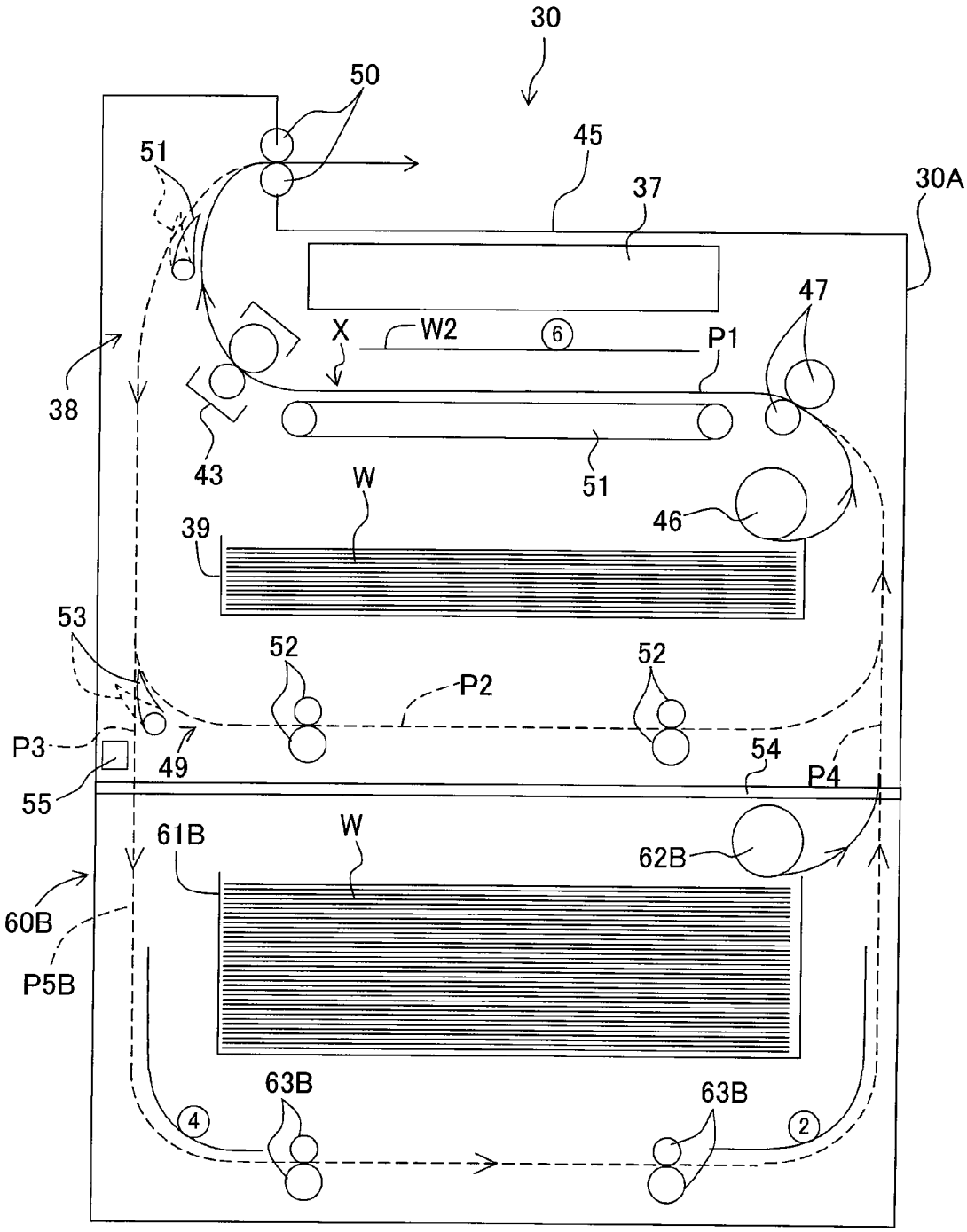
FIG. 4 schematically shows an internal structure of a printer executing a 246135 mode.
Figure 5:
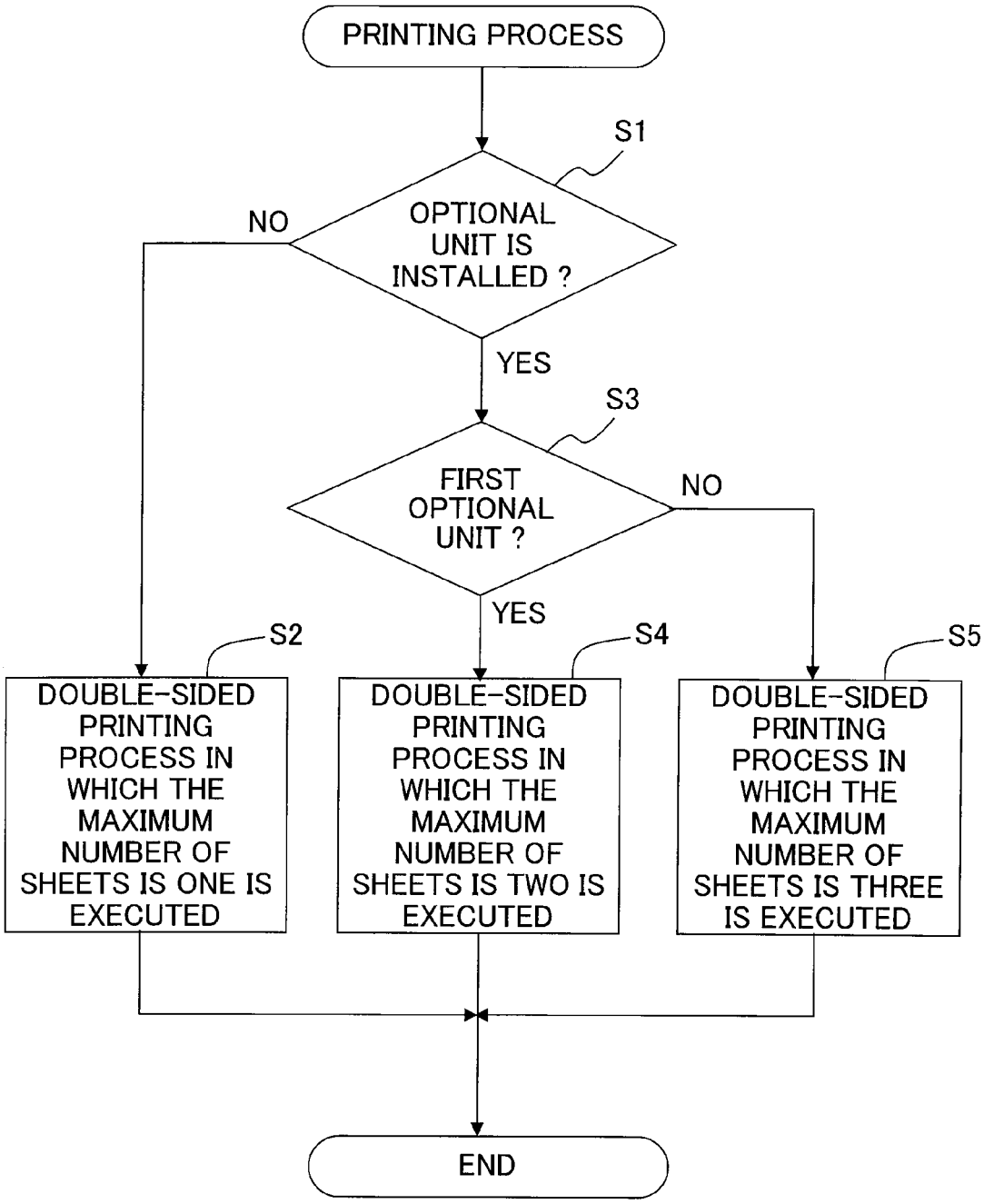
FIG. 5 is a flowchart showing a printing process.

In FIG. 2 to FIG. 4, each encircled number denotes that an image corresponding to a page to which each number is assigned is formed on a surface of the sheet W on which each number is assigned. For example, in FIG. 3, the image corresponding to the second page is printed on the upper surface of a sheet W1, and the image corresponding to the fourth page is printed on the upper surface of a sheet W2. The main body 30A includes the printing section 37, the transport mechanism 38, a main body cassette 39 (an example of a first sheet accommodating section), a fixing unit 43, a paper discharge tray 45, etc.

The main body cassette 39 can accommodate a plurality of sheets W therein in a stacked state and is detachably provided below the printing section 37.

The transport mechanism 38 includes a pickup roller 46, resist rollers 47, a transport belt 48, a reversing mechanism 49, etc. The pickup roller 46 takes the sheets W accommodated in the main body cassette 39 one-by-one and transports the sheet W to the resist rollers 47. The resist rollers 47 adjust a posture of the transported sheet W to send the sheet W onto the transport belt 48 at a predetermined timing.

The printing section 37 forms a monochrome (black and white) image or a color image onto the sheet W transported by the transport belt 48 at a predetermined printing position X, based on a printing data received from, for example, the terminal 10. The image formed on the sheet W is thermally fixed by the fixing unit 43, and then the sheet W is discharged on the paper discharge tray 45. A route (solid arrow in FIG. 2) for guiding the sheet W from the main body cassette 39 to the printing portion X is referred to as a print transport path P1.

The reversing mechanism 49 includes paper discharging rollers 50, a reversing transport path P2 (dotted-line arrow in FIG. 2, an example of a re-transport route), a flapper 51, a plurality of reversing transport rollers 52, etc. The reversing transport path P2 is configured to pass below the main body cassette 39. For example, in a case that the double-sided printing is performed on the double-sided continuous system, the image is printed on the back surface of the sheet W by the printing section 37, then, the sheet W is once transported to the paper discharging rollers 50. The back surface referred herein corresponds to the lower surface of the sheet W when the sheet W is accommodated in the main body cassette 39.

When the paper discharging rollers 50 are reversely rotated, the sheet W is transported via the flapper 51, the reversing transport path P2, the plurality of reversing transport rollers 52, and the resist rollers 47 to be fed on the transport belt 48 in a state that the front surface and the back surface of the sheet W are turned over. Then, the sheet W is discharged on the paper discharge tray 45 after the image is printed on the front surface by the printing section 37. The front surface referred herein is the upper surface of the sheet W when the sheet W is accommodated in the main body cassette 39.

Further, an output path P3 and an input path P4 are formed in the reversing mechanism 49. The output path P3 is a path which branches from the reversing transport path P2. The output path P3 guides the sheet W fed by inverse rotation of the paper discharging rollers 50 toward the optional unit 60. A flapper 53 is provided at a branch point at which the output path P3 branches from the reversing transport path 2. The transport route of the sheet W is switched by the flapper 53. The input path P4 is merged with the reversing transport path P2 so that the sheet W from a side of the optional unit 60 is fed into the main body 30A.

3. Option Detecting Section, Optional Unit, Option Install Section

As shown in FIGS. 3 and 4, an option install section 54 (an example of an install section) is provided at a lower portion of the main body 30A. The optional unit 60 can be added to the option install section 54. Further, the main body 30A is provided with an option detecting section 55. The option detecting section 55 has an unillustrated optical sensor or magnetic sensor. The option detecting section 55 detects whether or not the optional unit 60 is installed to the option install section 54. Further, when the optional unit 60 is installed to the option install section 54, the option detecting section 55 detects the type of the optional unit 60. Then, the option detecting section 55 sends the detecting results to the CPU 31.

As shown in FIGS. 3 and 4, the optional unit 60 includes two types of optional units (a first optional unit 60A and a second optional unit 60B). The first optional unit 60A and the second optional unit 60B include optional cassettes 61A, 61B (an example of a second sheet accommodating section), reversing transport paths P5A, P5B (an example of a transport route of the transport unit), and pickup rollers 62A, 62B, respectively.

The optional cassette 61A (61B) is capable of accommodating equal-sized sheets W therein in the stacked state. Here, the accommodatable number of sheets W of the optional cassette 61B is larger than that of the optional cassette 61A. Therefore, a height of the optional cassette 61B is greater than that of the optional cassette 61A. The reversing transport path P5A (P5B) is communicated with the output path P3 and the input path P4 disposed on the side of the main body 30A in a state that the optional unit 60 is installed to the option install section 54 (see FIGS. 3 and 4).

Further, the reversing transport path P5A (P5B) is formed to surround below the optional cassette 61A (61B). As described above, since the height of the optional cassette 61B is greater than that of the optional cassette 61A, a length of the reversing transport path P5B is longer than that of the reversing transport path P5A. In the present description, the length of each of the transport paths including the reversing transport path P5B etc. denotes a length in the transport direction.

4. Printing Process

For example, when a printing data, in which the double-sided printing is instructed, is received from the terminal 10, the CPU 31 executes the printing process. In this situation, the CPU 31 functions as the print control section.

At first, the CPU 31 judges, based on the detecting result from the option detecting section 55, whether or not the optional unit 60 is installed to the option install section 54 (S1: an example of an installation judgment process). As shown in FIG. 2, when the optional unit 60 is not installed to the option install section 54 (51: NO), the CPU 31 controls the printing section 37 and the transport mechanism 38 so that the double-sided printing process of a 21-mode, in which the maximum number of sheets W present at the same time in the transport mechanism 38 is one sheet, is executed (S2). In other words, the CPU 31 controls the printing section 37 and the transport mechanism 38 so that the double-sided printing process of the 21-mode, in which the maximum number of sheets W present at the same time at least in the reversing transport path P2 of the print transport path P1 and the reversing transport path P2 is one sheet, is executed. In the present description, a transport system in which the maximum number of sheets W present at the same time in the transport mechanism 38 is n sheet(s) is referred to as a transport system of n sheet(s). The sheet W referred herein is preferably a sheet W, on which the image is formed on one surface thereof by passing through the printing position X but the image is not yet formed on the other surface thereof Further, in FIG. 2, the reversing transport path P2 is the only re-transport route for guiding said sheet W to the printing position X again.

Next, the 21-mode will be explained with reference to FIG. 2. On the 21-mode, the printing on one surface and the printing on the other surface are continuously performed per one sheet W from the start of the printing until the end of the printing. For example, when the images corresponding to six pages are printed by the double-sided printing onto three sheets W, the printer 30 performs the printing in the following order:

Image corresponding to the second page (the back surface of the first sheet W1)

Image corresponding to the first page (the front surface of the first sheet W1)

Image corresponding to the fourth page (the back surface of the second sheet W2)

Image corresponding to the third page (the front surface of the second sheet W2)

Image corresponding to the sixth page (the back surface of the third sheet W3)

Image corresponding to the fifth page (the front surface of the third sheet W3)

On the 21-mode, the printer 30 does not perform the printing on another sheet W during a time after the printing on the back surface of one sheet W is performed and before the printing on the front surface of said one sheet W is performed. For example, as shown in FIG. 2, the printing on each sheet W subsequent to the first sheet W1 is never performed during the time after the image corresponding to the second page is printed on the back surface of the first sheet W1 and before the image corresponding to the first page is printed on the front surface of said first sheet W1. Therefore, the maximum number of sheets W present at the same time in the transport mechanism 38 is one sheet. When the double-sided printing process of the 21-mode is completed, the CPU 31 ends the printing process.

When the CPU 31 judges that the optional unit 60 is installed to the option install section 54 (S1: YES), the CPU 31 judges, based on the detecting result, whether the optional unit 60 is the first optional unit 60A, in other words, whether the optional unit 60 is an optional unit having a short reversing transport path (S3). As shown in FIG. 3, when the optional unit 60 installed is the first optional unit 60A (S3: YES), the CPU 31 controls the printing section 37 and the transport mechanism 38 so that the double-sided printing process is executed on a transport system in which the maximum number of sheets W present at the same time in the transport mechanism 38 is two or more sheets (S4). In FIG. 3, in addition to the reversing transport path P2, the transport route passing through the reversing transport path P5A is the re-transport route. The reversing transport path P5A has the length longer than that of the reversing transport path P2 in a transport direction.

The transport system in which the maximum number of sheets is two or more sheets includes, for example, as follows:

2413-mode: A system in which the printing is performed on the back surfaces of the first and second sheets respectively, and then the printing is performed on the front surfaces of the first and second sheets respectively.

246135-mode: A system in which the printing is performed on the back surfaces of the first, second, and third sheets respectively, and then the printing is performed on the front surfaces of the first, second, and third sheets respectively.

Next, the 2413-mode will be explained with reference to FIG. 3. The 2413-mode includes a step in which the printing on the back surface of the second sheet W2 is performed during the time after the printing on the back surface of the first sheet W1 is performed and before the printing on the front surface of said first sheet W1 is performed. For example, when the images corresponding to eight pages are printed by the double-sided printing onto four sheets W1 to W4, the printer 30 performs the printing in the following order:

Image corresponding to the second page (the back surface of the first sheet W1)

Image corresponding to the fourth page (the back surface of the second sheet W2)

Image corresponding to the first page (the front surface of the first sheet W1)

Image corresponding to the third page (the front surface of the second sheet W2)

Image corresponding to the sixth page (the back surface of the third sheet W3)

Image corresponding to the eighth page (the back surface of the fourth sheet W4)

Image corresponding to the fifth page (the front surface of the third sheet W3)

Image corresponding to the seventh page (the front surface of the fourth sheet W4)

On the 2413-mode, for example as shown in FIG. 3, in a case that the first sheet W1 (the image corresponding to the second page has been printed thereon) is present in the reversing transport path P5A, the second sheet W2 is present in the print transport path P1. Thus, the maximum number of sheets W present at the same time in the transport mechanism 38 is two sheets. Accordingly, the throughput of the double-sided printing can be improved as compared with the case shown in FIG. 2. When the double-sided printing process of the 2413-mode is completed, the CPU 31 ends the printing process. Further, the double-sided printing process in which the maximum number of sheets is two sheets may be performed on not only the sheets W supplied from the optional cassette 61A but also the sheets W supplied from the main body cassette 39.

As shown in FIG. 4, when the second optional unit 60B is installed to the option install section 54 (S3: NO), the CPU 31 controls the printing section 37 and the transport mechanism 38 so that the double-sided printing process is executed on a transport system of three sheets (S5). In FIG. 4, in addition to the reversing transport path P2, the transport route passing through the reversing transport path P5B is the re-transport route. The reversing transport path P5B has the length longer than that of the reversing transport path P2. Further, since the reversing transport route path P5B is longer than the reversing transport route P5A as described above, it is possible, in FIG. 4, to execute a double-sided printing process (of a system) in which the maximum number of sheets W present at the same time in the transport mechanism 38 is large as compared with the case shown in FIG. 3.

As an example of the transport system of three sheets, the above 246135-mode can be cited. As described above, the 246135-mode includes a step in which the printing on the back surfaces of the second and third sheets W2, W3 is performed during the time after the printing on the back surface of the first sheet W1 is performed and before the printing on the front surface of said first sheet W1 is performed. For example, when the images corresponding to six pages are printed by the double-sided printing onto three sheets W1 to W3, the printer 30 performs the printing in the following order:

Image corresponding to the second page (the back surface of the first sheet W1)

Image corresponding to the fourth page (the back surface of the second sheet W2)

Image corresponding to the sixth page (the back surface of the third sheet W3)

Image corresponding to the first page (the front surface of the first sheet W1)

Image corresponding to the third page (the front surface of the second sheet W2)

Image corresponding to the fifth page (the front surface of the third sheet W3)

On the 246135-mode, for example as shown in FIG. 4, in a case that the first sheet W1 (the image corresponding to the second page has been printed thereon) and the second sheet W2 (the image corresponding to the fourth page has been printed thereon) are present in the reversing transport path P5B, the third sheet W3 is present in the print transport path P1. Therefore, the maximum number of sheets W present at the same time in the transport mechanism 38 is three sheets. Accordingly, in the case shown in FIG. 4, the throughput of the double-sided printing can be improved as compared with the cases shown in FIG. 2 and FIG. 3. When the double-sided printing process of the 246135-mode is completed, the CPU 31 ends the printing process. Further, the double-sided printing process of the transport system of three sheets may be performed on not only the sheets W supplied from the optional cassette 61A but also the sheets W supplied from the main body cassette 39.

Further, since the reversing transport path P2 is provided in the main body 30A, even when the optional unit 60 is not installed to the option install section 54 as shown in FIG. 2, it is possible to perform the double-sided printing of a transport system of two sheets. Therefore, it is preferable that the double-sided printing of the transport system of three sheets is performed in the case of FIG. 3 and that the double-sided printing of a transport system of four sheets is performed in the case of FIG. 4.

5. Effect of the Embodiment

According to the embodiment, as shown FIGS. 3 and 4, when the optional unit 60 is installed to the option install section 54, a double-sided printing process, in which the maximum number of sheets W present at the same time in the transport mechanism 38 is large as compared with the case shown in FIG. 2 in which the optional unit 60 is not installed, is executed (an example of a print control process). When the optional unit 60 is installed to the printer 30 according to the embodiment, in addition to the reversing transport path (for example, the reversing transport path P2) formed in the printer 30, it is possible to use the reversing transport path (for example, reversing transport path P5 etc.) passing through the optional unit 60. Here, the reversing transport path passing through the optional unit 60 is longer than the reversing transport path formed in the printer 30. Therefore, it is possible to stay a larger number of sheets in the reversing transport path passing through the optional unit 60 as compared with the reversing transport path formed in the printer 30. In view of this, in the printer 30 according to this embodiment, when the reversing transport path passing through the optional unit 60 is usable, a double-sided printing process, in which the larger number of sheets are stayed in the reversing transport path of the optional unit 60 as compared with the number of sheets stayed in the reversing transport path formed in the printer 30, is selected and executed. Accordingly, (when the double-sided printing process, in which the larger number of sheets are stayed in the reversing transport path of the optional unit 60 as compared with the number of sheets stayed in the reversing transport path formed in the printer 30, is performed), it is possible to reduce a waiting time for reversing the sheet causing after the printing on the first sheet is started and before the last sheet is discharged, thereby making it possible to increase the number of sheets printed per unit time of the double-sided printing (making it possible to improve the throughput).

According to this embodiment, as the entire length of the transport route of the installed optional unit 60 is longer, the double-sided printing process in which the maximum number of sheets is larger is executed. Thus, it is possible to improve the throughput of the double-sided printing depending on the entire length of the transport route.

Further, the optional unit 60 has the optional cassettes 61A, 61B which have different maximum numbers of sheets accommodatable therein from each other. Thus, it is possible to increase the number of sheets W usable for the printing by installing such a optional unit 60 to the option install section 54.

According to this embodiment, by transporting the sheets W accommodated in the main body cassette 39 via the reversing transport paths P5A, P5B, the double-sided printing process, in which the maximum number of sheets W present at the same time in the transport mechanism 38 is large as compared with the case in which the optional unit 60 is not installed to the option install section 54, is executed. Therefore, it is possible to improve the throughput not only when the double-sided printing is performed on the sheets W accommodated in the optional cassettes 61A, 61B but also when the double-sided printing is performed on the sheets W accommodated in the main body cassette 39.

Second Embodiment

Although the content of the printing process and a transportable width of the reversing transport path of the optional unit 60 are different between the first and second embodiments, all other respects are the same between the first and the second embodiments. Thus, constitutive parts or components, which are the same as or equivalent to those of the first embodiment, are designated by the same reference numerals, any explanation of which will be omitted as appropriate. Only those different from the first embodiment will be explained below.

Figure 6:
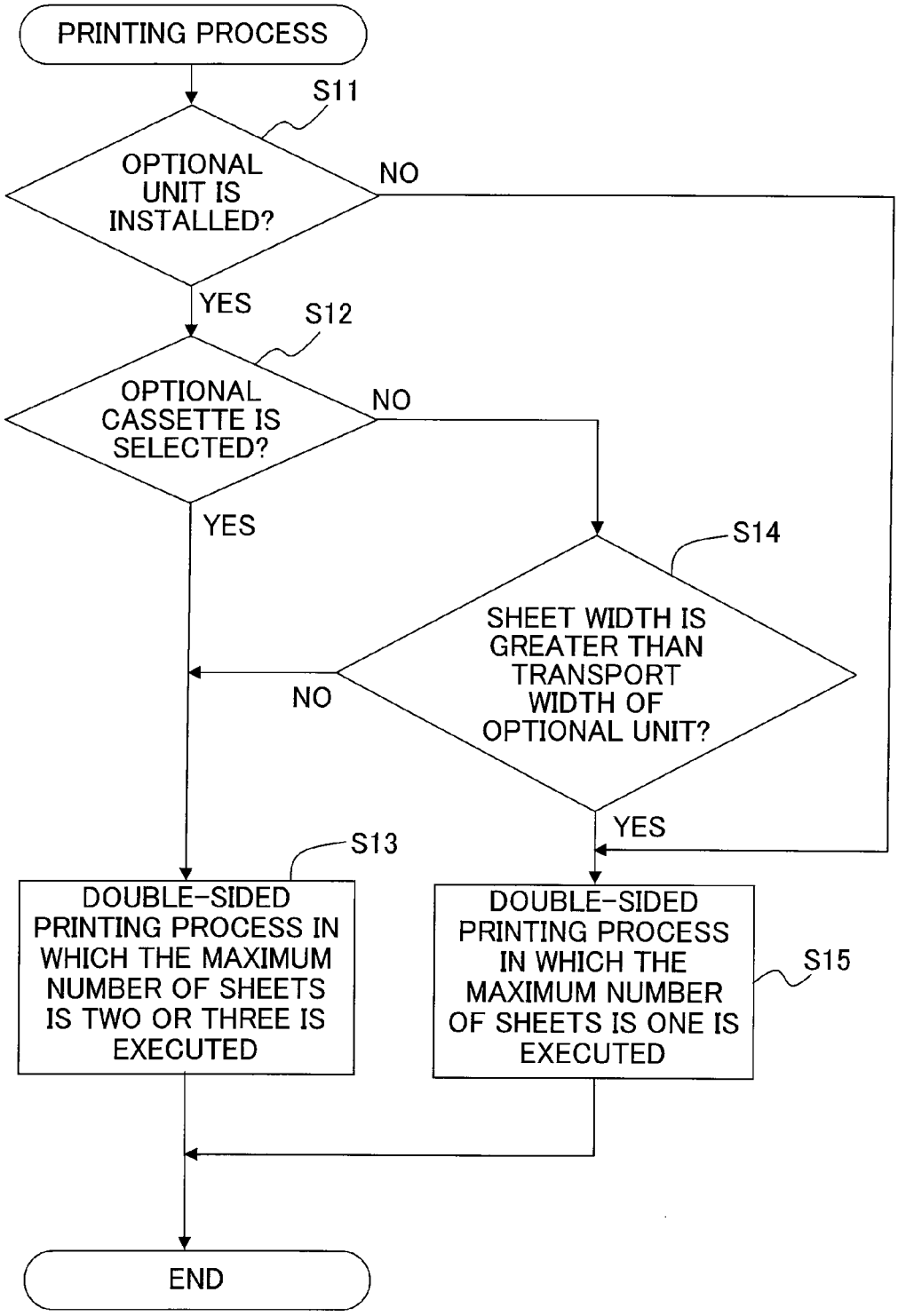
FIG. 6 is a flowchart showing a printing process according to the second embodiment.

As shown in FIG. 6, when the printing data, in which the double-sided printing is instructed, is received from, for example, the terminal 10, the CPU 31 executes the printing process. In this situation, the CPU 31 functions as the print control section.

At first, the CPU 31 judges whether the optional unit 60 is installed to the option install section 54 based on the detecting result from the option detecting section 55 (S11). When the optional unit 60 is not installed to the option install section 54 (S11: NO), the CPU 31 executes the double-sided printing process of the 21-mode as shown in FIG. 2 (S15). Then, the printing process is completed.

When the optional unit 60 is installed to the option install section 54 (S11: YES), the CPU 31 judges whether any one of the optional cassettes 61A and 61B is selected in setting information included in the printing data (S 12). When any one of the optional cassettes 61A and 61B is selected (S12: YES), the double-sided printing process is executed on the sheet W fed from the selected optional cassette 61A or 61B.

In particular, by utilizing the reversing transport path of the optional unit 60, the double-sided printing process, in which the maximum number of sheets W present at the same time in the transport mechanism 38 is large as compared with the case in which the optional unit 60 is not installed, is executed (S13), and the printing process is completed. In general, a sheet width accommodatable in the optional cassette corresponds to a transport width of the reversing transport path in the same optional unit 60. Thus, when the optional cassette is selected, it is possible to use the reversing transport path of the optional unit in which the optional cassette is arranged. It is noted that the sheet width and the transport width are width dimensions in a direction perpendicular to the transport direction.

When the main body cassette 39 is selected (S12: NO), the CPU 31 judges whether the sheet width of the sheet W accommodated in the main body cassette 39 is greater than the transport width of the reversing transport path of the optional unit 60 (S14). The CPU 31 grasps the sheet width and the transport width based on, for example, the detecting results from the option detecting section 55 or set contents inputted and set by the user through the operation section 35 or the operation section 15 (in particular, the size of the printing paper and the like).

When the sheet width is not more than the transport width (S14: NO), it is possible to transport the sheet W from the main body cassette 39 by the reversing transport path of the optional unit 60. Thus, the double-sided printing process, in which the maximum number of sheets W present at the same time in the transport mechanism 38 is large as compared with the case in which the optional unit 60 is not installed, is executed (S13), and the printing process is completed.

Figure 7:
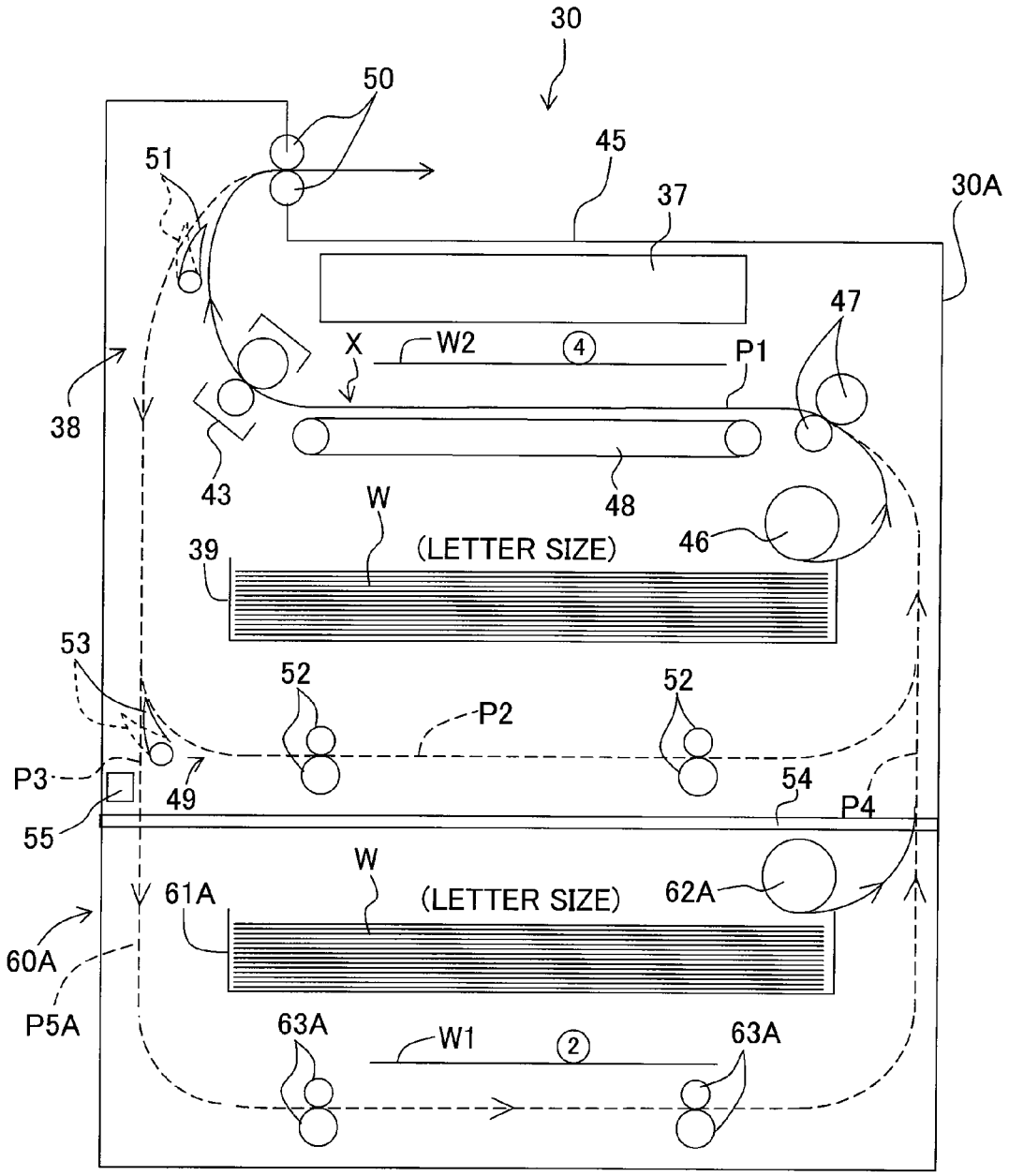
FIG. 7 schematically shows the internal structure of the printer executing the 2413 mode according to the second embodiment.

More specifically, in FIG. 7, the sheet W having a letter size is accommodated in the main body cassette 39 and the sheet W having the same letter size as that accommodated in the main body cassette 39 is accommodated in the optional cassette 60A. Corresponding to this, the transport width of the reversing transport path P5A is also substantially equal to a length of the short side of the sheet W having the letter size. Thus, it is possible to transport the sheet W having the letter size fed from the main body cassette 39 to not only the reversing transport path P2 in the main body cassette 39 but also to the reversing transport path P5A in the optional unit 60A. Then, the CPU 31 controls the printing section 37 and the transport mechanism 38 so that the sheet W having the letter size fed from the main body cassette 39 is transported by the reversing transport path P5A to execute the double-sided printing process of the transport system of two sheets (S13). Accordingly, it is possible to improve the throughput of the double-sided printing as compared with the case in which the reversing transport path P2 is used (see FIG. 2).

On the other hand, when the sheet width is greater than the transport width of the reversing transport path of the optional unit 60 (S14: YES), the sheet W fed from the main body cassette 39 can not be transported by the reversing transport path of the optional unit 60. Only the reversing transport path P2 in the main body cassette 39 can transport the sheet W fed from the main body cassette 39. Therefore, the double-sided printing process, which is the same as that of the case in which the optional unit 60 is not installed, is executed (S15), and the printing process is completed.

Figure 8:
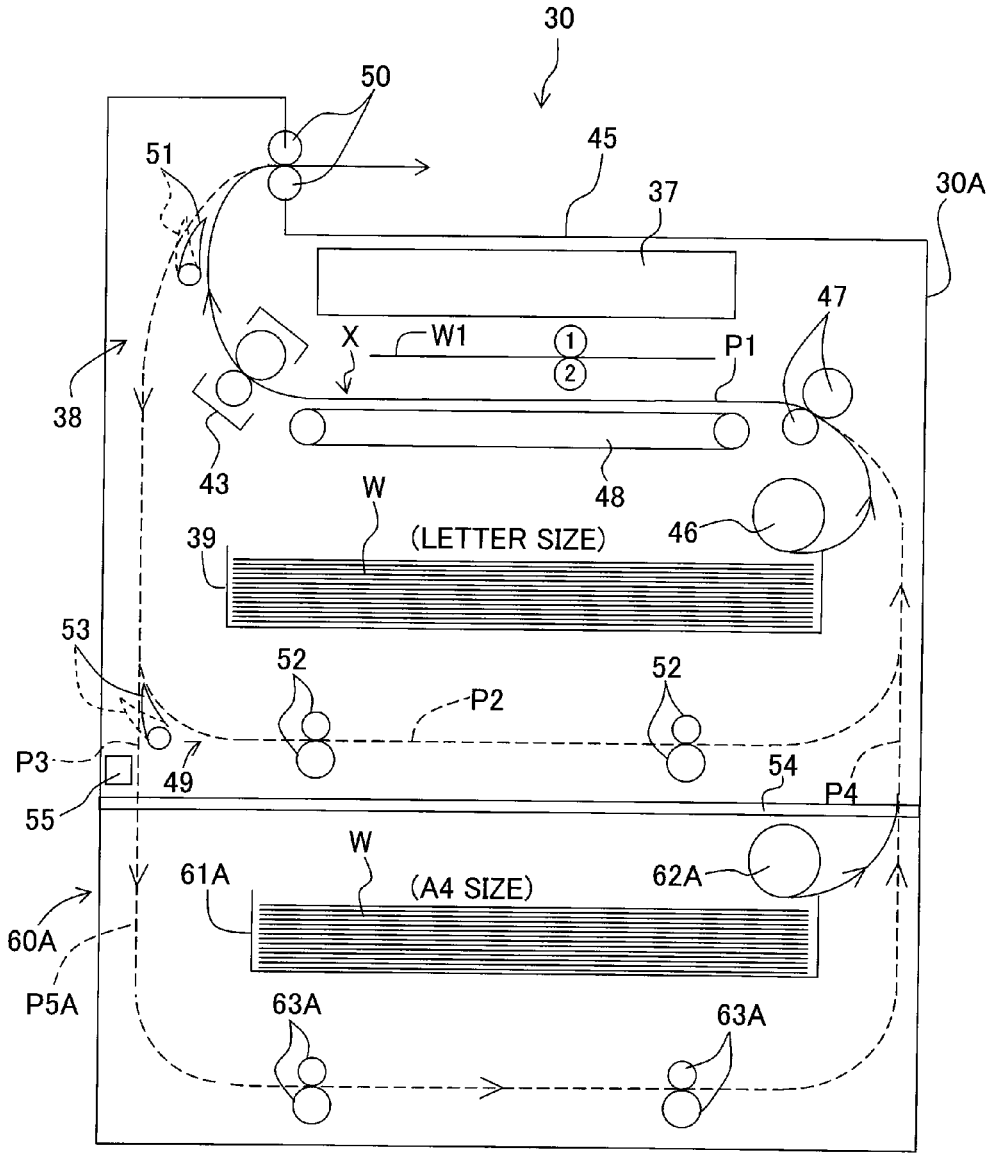
FIG. 8 schematically shows the internal structure of the printer executing the 21 mode according to the second embodiment.

More specifically, in FIG. 8, while the sheet W having the letter size is accommodated in the main body cassette 39, the sheet W having a A4 size, which has the sheet width smaller than that of the letter size, is accommodated in the optional unit 60. Corresponding to this, the transport width of the reversing transport path P5A is set substantially equal to the length of the short side (sheet width) of the sheet W having the A4 size. Therefore, it is not possible to transport the sheet W having the letter size fed from the main body cassette 39 by the reversing transport path P5A, and only the reversing transport path P2 can be used to transport the sheet W having the letter size.

Thus, the CPU controls the printing section 37 and the transport mechanism 38 so that the sheet W having the letter size fed from the main body cassette 39 is transported by the reversing transport path P2 to execute a double-sided printing process in which the maximum number of sheets W is equivalent to or less than that of the case in which optional unit 60 is not installed (S15). By doing so, it is possible to suppress the erroneous situation such that when the sheet width is greater than the transport width, the sheet W fed from the main body cassette 39 is transported to the reversing transport path of the optional unit 60 to cause a transport error.

According to this embodiment, when the optional unit 60 is installed to the option install section 54 and when the sheet width of the sheet W accommodated in the main body cassette 39 is smaller than the lateral width of the reversing transport path of the optional unit 60, the sheet W is transported via the reversing transport path of the optional unit 60. In this case, a double-sided printing process, in which the maximum number of sheets is large as compared with the case in which the sheet width is greater than the lateral width of the reversing transport path of the optional unit 60, is executed. Accordingly, it is possible to improve the throughput of the double-sided printing on the sheet W accommodated in the main body cassette 39 within a transportable range in which the sheet width is considered.

Other Embodiments

The present teaching is not limited to the embodiments explained through the above descriptions and drawings but, for example, the following various embodiments are also included in the technical scope of the present teaching. Nevertheless, these various embodiments are just exemplified to specify the technical scope of the present teaching, and the present teaching is not limited to these embodiments.

In the above embodiments, the main body 30A is configured so that the reversing transport path P2 passes below the main body cassette 39. However, the main body 30A may be configured so that the reversing transport path P2 passes above the main body cassette 39. Further, the optional unit 60 may also be configured so that the reversing transport path P5A (P5B) passes above the optional cassette 61A (61B).

In the above embodiments, presence or absence of the installation of the optional unit 60 and the type of the optional unit 60 are judged based on the detecting results from the option detecting section 55. However, for example, the following configuration is allowable. That is, the user inputs and sets, through the operation section 35 or the operation section 15, whether the optional unit 60 is installed to the option install section 54, and then judgment is performed by the CPU 31 based on the setting.

In the above embodiments, as the length of the reversing transport path of the installed optional unit 60 is longer, the double-sided printing process having the larger maximum number of sheets is executed. However, there is a configuration in which a plurality of optional units 60 are connected in series and installed to the option install section 54. In this configuration, it is allowable that, as the number of the optional units 60 connected in series is larger, the double-sided printing process having the larger maximum number of sheets is executed. In this case, the option detecting section 55 is preferably configured to detect the number of the optional units 60 connected in series.

In the embodiments described above, the main body 30A is configured to include the main body cassette 39 and reversing transport path P2. However, the main body 30A may be configured to include any one of the main body cassette 39 and the reversing transport path P2.

In the above embodiments, the optional unit 60 is configured to have the optional cassettes 61A, 61B. However, it is allowable that the optional unit 60 does not have the optional cassettes 61A, 61B. In other words, it is allowable to adopt any transport unit having a transport route for lengthening the re-transport route. Further, it is also allowable to adopt a transport unit which is installed on the side of the side surface or the upper side of the main body 30A.

Figure 9:
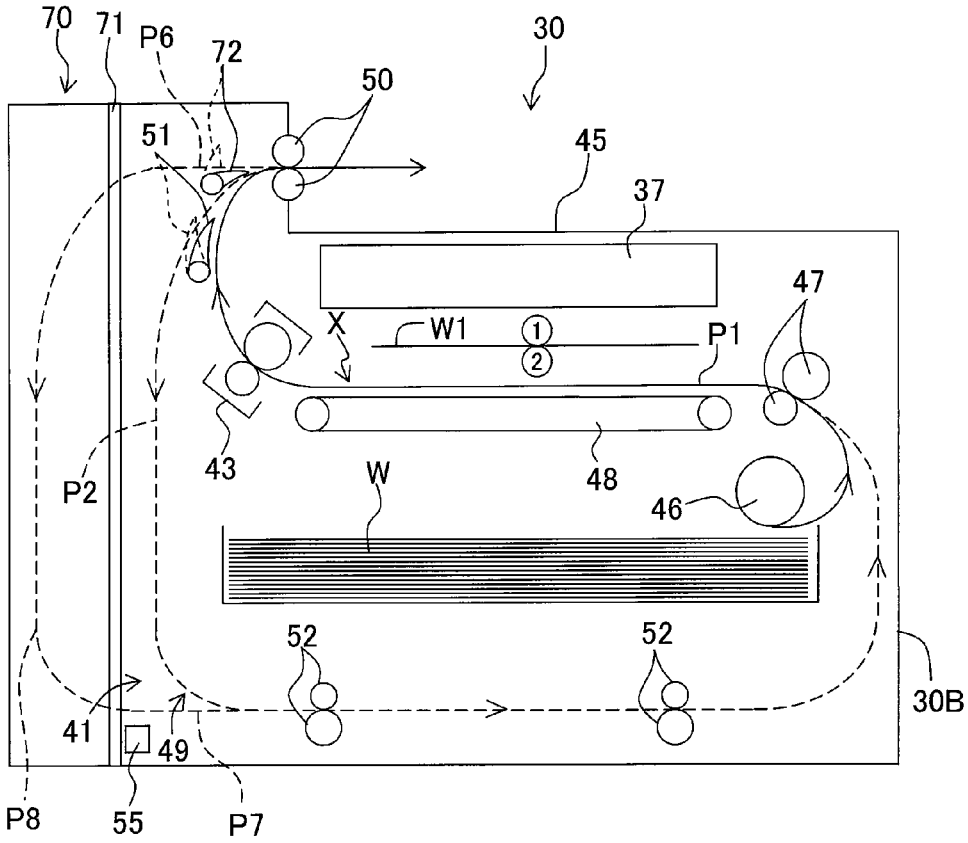
FIG. 9 schematically shows an internal structure of a printer according to a modified embodiment.

FIG. 9 shows a construction in which an optional unit 70 which does not have the sheet accommodating section is installed on the side of the side surface of a main body 30B. An option install section 71 is provided on the rear surface of the main body 30B. The option detecting section 55 detects the presence or absence of the installation of the optional unit 70 to the option install section 71, the type of the optional unit 70, etc. The reversing mechanism 49 includes an output path P6, an input path P7, and a flapper 72. The optional unit 70 includes a reversing transport path P8. The reversing transport path P8 is communicated with the output path P6 and the input path P7 in the main body 30B in a state that the optional unit 70 is installed to the option install section 71. By installing the optional unit 70, the re-transport route becomes longer as compared with the case in which the optional unit 70 is not installed.

In the above embodiments, when the plurality of optional units 60 are connected and installed, the CPU 31 may perform the following process. That is, the sheet W accommodated in the optional cassette of the optional unit 60 disposed at an upper stage is transported by the reversing transport path of the optional unit 60 disposed at a stage lower than said upper stage. Then, a double-sided printing process, in which the maximum number of sheets is large as compared with the case in which the optional unit 60 at the lower stage is not installed, is executed. Therefore, it is possible to improve the throughput not only when the double-sided printing is performed on the sheet W accommodated in the optional cassette of the optional unit 60 at the lower stage, but also when the double-sided printing is performed on the sheet W accommodated in the optional cassette of the optional unit 60 at the upper stage.

Further, the CPU 31 may perform the following process. That is, when the sheet width of the sheet W accommodated in the optional cassette of the optional unit 60 at the upper stage is smaller than the lateral width of the reversing transport path of the optional unit 60 at the lower stage, the sheet W is transported by the reversing transport path of the optional unit 60 at the lower stage. Then, the double-sided printing process, in which the maximum number of sheets is large as compared with the case in which the sheet width is not less than the lateral width of the reversing transport path, is executed. Accordingly, it is possible to improve the throughput of the double-sided printing on the sheet W accommodated in the optional cassette of the optional unit 60 at the upper stage, within the range in which the sheet width is considered.

In the above embodiments, when the plurality of modes are executable, the user may instruct and determine whether or not the double-sided printing process having the larger maximum number of sheets is executed. For example, in the case shown in FIG. 4, the user may input and specify, through the operation section 15 or the operation section 35, which one of the 21 mode, 2413 mode, and the 246135 mode is executed.

In the above embodiments, the printing process is executed by one CPU 31. However, the printing process may be executed by a plurality of CPUs or a hardware circuit, such as one or a plurality of ASIC(s) (Application Specific Integrated Circuit(s)).

What is claimed is:

1. A printing apparatus which performs printing on a sheet, comprising:

a printing section which performs the printing on the sheet at a printing position;

a transport mechanism in which a transport route which guides the sheet to the printing position and a re-transport route which guides the sheet having passed through the printing position to the printing position again are formed, the transport mechanism including an install section to which a transport unit, in which an extended route connected to the re-transport route to form a part of the re-transport route thereby lengthening a length of the re-transport route is formed, is to be installed;

a print control section which controls the printing section and the transport mechanism to execute a plurality of kinds of double-sided printing processes having different maximum numbers of sheets present at the same time in the transport mechanism from each other so that in a case that the transport unit is installed to the install section, a double-sided printing process, among the double-sided printing processes, in which a maximum number of sheets is large as compared with a case in which the transport unit is not installed to the install section is executed; and an option detecting section which is configured to detect as to whether or not the transport unit is installed to the install section, wherein the print control section is configured to determine whether or not the transport unit is installed to the install section based on a detection result of the option detecting section, under a condition that the print control section determines that the transport unit is not installed to the install section, the print control section controls the printing section and the transport mechanism to execute a double-side printing processes having a single sheet present at a time in the transport mechanism, and under a condition that the print control section determines that the transport unit is installed to the install section, the print control section controls the printing section and the transport mechanism to execute a double-sided printing processes having a plurality of sheets present at the same time in the transport mechanism.

2. The printing apparatus according to claim 1, wherein the transport unit is installed to the install section.

3. The printing apparatus according to claim 1, wherein the transport unit includes a plurality of transport units in which a plurality of extended routes, which change the re-transport route to have different lengths from each other, are formed respectively, wherein one of the transport units is installed to the install section, and wherein, when a length of the re-transport route is in a state that the one of the transport units is installed to the install section is longer, a double-sided printing process, among the double-sided printing processes, in which the maximum number of sheets is large is executed by the print control section.

4. The printing apparatus according to claim 3, wherein as the number of the transport units installed is larger, a double-sided printing process, among the double-sided printing processes, in which the maximum number of sheets is large is executed by the print control section.

5. The printing apparatus according to claim 3, wherein the transport unit includes a sheet accommodating section accommodating the sheet, and the extended route is formed, in the transport unit, to surround a side opposite to the install section with the sheet accommodating section intervening therebetween, and wherein, as an accommodatable number of sheets of the sheet accommodating section provided in the transport unit installed to the install section is larger, a double-sided printing process, among the double-sided printing processes, in which the maximum number of sheets is large is executed by the print control section.

6. The printing apparatus according to claim 1, further comprising:

a first sheet accommodating section which accommodates the sheet, wherein the transport unit includes a second sheet accommodating section which accommodates the sheet, and wherein the transport unit is configured to be installed to the install section in a state of having the first sheet accommodating section.

7. The printing apparatus according to claim 6, wherein in a case that the transport unit is installed to the install section, the print control section controls the printing section and the transport mechanism to execute a double-sided printing process, among the double-sided printing processes, in which the maximum number of sheets is large as compared with a case in which the transport unit is not installed to the install section, so that the sheet accommodated in the first sheet accommodating section is transported by the extended route of the transport unit.

8. The printing apparatus according to claim 7, wherein in a case that the transport unit is installed to the install section and further that a sheet width of the sheet accommodated in the first sheet accommodating section is not more than a lateral width of the transport route of the transport unit, the print control section controls the printing section and the transport mechanism to execute a double-sided printing process, among the double-sided printing processes, in which the maximum number of sheets is large as compared with a case in which the sheet width is larger than the lateral width of the transport route, so that the sheet is transported by the extended route of the transport unit.

9. The printing apparatus according to claim 1, further comprising:

as the transport unit, a first transport unit and a second transport unit, each of which has a second sheet accommodating section accommodating the sheet and is connected to the install section, wherein in a case that the first transport unit and the second transport unit are installed to the install section, the print control section controls the printing section and the transport mechanism to execute a double-sided printing process, among the double-sided printing processes, in which the maximum number of sheets is large as compared with a case in which the second transport unit is not installed to the install section, so that the sheet accommodated in the second sheet accommodating section of the first transport unit is transported by the extended route of the second transport unit, which is connected at a position separated farther from the install section than the first transport unit.

10. The printing apparatus according to claim 9, wherein, in a case that the first transport unit and the second transport unit are installed to the install section and further that a sheet width of the sheet accommodated in the second sheet accommodating section of the first transport unit is not more than a lateral width of the transport route of the second transport unit, the print control section controls the printing section and the transport mechanism to execute a double-sided printing process, among the double-sided printing processes, in which the maximum number of sheets is large as compared with a case in which the sheet width is larger than the lateral width of the extended route of the second transport unit, so that the sheet is transported by the extended route of the second transport unit.

11. The printing apparatus according to claim 1, further comprising:

an instruction obtaining section, which obtains an instruction information by a user, about which one of a first double-sided printing process and a second double-sided printing process, among the double-sided printing processes, in which the maximum number of sheets is smaller than that of the first double-sided printing process is executed, wherein in a case that the transport unit is installed to the install section and further that the instruction obtaining section obtains an instruction information in which the first double-sided printing process is executed, the first doubled-sided printing is executed by the print control section.

12. A non-transitory tangible media storing a double-sided printing control program which makes a computer of an image forming apparatus execute an installation judging process and a print controlling process, wherein the image forming apparatus includes a printing section which performs printing on a sheet at a printing position, a transport mechanism in which a transport route that guides the sheet to the printing position and a re-transport route that guides the sheet having passed through the printing position to the printing position again are formed, and the transport mechanism includes an install section to which a transport unit, in which an extended route which is connected to the re-transport route to form a part of the re-transport route thereby lengthening a length of the re-transport route is formed, is installed, and an option detecting section which is configured to detect as to whether or not the transport unit is installed to the install section, the installation judging process comprises:

a process in which whether or not the transport unit is installed to the install section is judged based on a detection result of the option detecting section; and the print controlling process comprises:

a process in which under a condition that the transport unit is judged to be installed to the install section in the installation judging process, a double-sided printing process, in which a maximum number of sheets present at the same time in the transport mechanism is large as compared with a case in which the transport unit is judged not to be installed to the install section in the installation judging process, is executed by the printing section and the transport mechanism, wherein, under a condition that the transport unit is determined not to be installed to the install section, a double-sided printing processes having a single sheet present at a time in the transport mechanism is executed by the printing section and the transport mechanism, and wherein, under a condition that the transport unit is determined to be installed to the install section, a double-sided printing processes having a plurality of sheets present at the same time in the transport mechanism is executed by the printing section and the transport mechanism.

13. The printing apparatus according to claim 1, wherein the option detecting section is configured to distinguish a first transport unit in which a first extended route is formed and a second transport unit in which a second extended route that is longer than the first extended route is formed, wherein the print control section is configured to determine whether or not the first or second transport unit is installed to the install section based on a detection result of the option detecting section, wherein, under a condition that the print control section determines that the first transport unit and the second transport unit are not installed to the install section, the print control section controls the printing section and the transport mechanism to execute a double-sided printing processes having a single sheet present at a time in the transport mechanism, and wherein, under a condition that the print control section determines that the first transport unit is installed to the install section, the print control section controls the printing section and the transport mechanism to execute a double-sided printing processes having two sheets present at the same time in the transport mechanism, and wherein, under a condition that the print control section determines that the second transport unit is installed to the install section, the print control section controls the printing section and the transport mechanism to execute a double-sided printing processes having three sheets present at the same time in the transport mechanism.

14. The non-transitory tangible media according to claim 12, wherein the option detecting section is configured to distinguish a first transport unit in which a first extended route is formed and a second transport unit in which a second extended route that is longer than the first extended route is formed, wherein, in the installation judging process, the first or second transport unit is determined to be installed or not installed to the install section based on the detection result of the option detecting section, wherein, under a condition that each of the first transport unit and the second transport unit is determined to not be installed to the install section, the double-sided printing processes having a single sheet present at a time in the transport mechanism is executed by the printing section and the transport mechanism, wherein, under a condition that the first transport unit is determined to be installed to the install section, a double-sided printing processes having two sheets present at the same time in the transport mechanism is executed by the printing section and the transport mechanism, and wherein, under a condition that the second transport unit is determined to be installed to the install section, a double-sided printing processes having three sheets present at the same time in the transport mechanism is executed by the printing section and the transport mechanism.

* * * * *